United States Patent [19]

Dowd et al.

[11] 4,140,270

[45] Feb. 20, 1979

[54] CENTRIFUGAL SEPARATOR FOR FOOD PRODUCTS

[75] Inventors: Brian M. Dowd, New York, N.Y.; John A. Kneeland, Kentfield, Calif.

[73] Assignee: Western Dairy Products, San Francisco, Calif.

[21] Appl. No.: 849,071

[22] Filed: Nov. 7, 1977

[51] Int. Cl.[2] ..... B04B 11/06

[52] U.S. Cl. ..... 233/3; 233/1 A; 233/32; 233/47 R

[58] Field of Search ..... 233/1 R, 3, 27, 28, 233/32, 33, 34, 38, 40, 41, 44, 46, 47 R, 1 A; 241/275, 168, 257

[56] References Cited

U.S. PATENT DOCUMENTS

| | | | |
|---|---|---|---|
| 2,104,683 | 1/1938 | Van Rosen et al. | 233/3 |
| 2,353,983 | 7/1944 | Banning | 233/3 X |
| 2,900,129 | 8/1959 | Dega | 233/46 X |
| 3,209,995 | 10/1965 | Prijatel | 233/3 |
| 4,015,784 | 4/1977 | Hughes | 241/162 |
| 4,063,715 | 12/1977 | Felker et al. | 233/3 X |

*Primary Examiner*—George H. Krizmanich

*Attorney, Agent, or Firm*—Thomas M. Freiburger

[57] ABSTRACT

A centrifugal separator particulary adapted for food products removes foreign particles and objects which are denser than the main slurry. It is especially effective in removing trace amounts of metal and bone fragments and other hard foreign material from meats, emulsified batters and other food mixtures without materially changing the physical character of the input product. The separator includes a centrifuge chamber with a central impeller, with specific spatial relationships between the impeller and the nearby axially disposed inlet opening. Food batter or slurry is moved through the separator by the action of the impeller driving the slurry radially outwardly, in combination with a set of pumping vanes positioned adjacent to and communicating with the centrifuge chamber. Foreign matter denser than the main batter or slurry collects on a peripheral wall of the chamber and is not discharged, it being generally of small volume. An easily removable stationary cover over the centrifuge chamber includes an annular ledge that forms a non-contacting seal with an annular projection on the rotatable chamber body to prevent leakage of the purified slurry being pumped.

15 Claims, 7 Drawing Figures

CENTRIFUGAL SEPARATOR FOR FOOD PRODUCTS

BACKGROUND OF THE INVENTION

The invention relates to centrifugal separation apparatus, and more specifically to a separator for removing hard, dense foreign objects from food products.

Separation of mixed substances of differing densities, particularly in liquids or fluidized slurries, has been carried out in many instances by the use of centrifuges. For example, see the disclosures of U.S. Pat. Nos. 3,880,347, 2,741,333 and 2,782,925. The first listed patent shows a light and heavy material centrifuge separator in which the heavies were passed through an outer port while the lights were passed through an inner port. The fluid mixture entering the centrifuge inlet had to be pressurized in order to move the separated components, particularly the heavies, through the apparatus to the outlet. A portion of the travel was against centrifugal force.

U.S. Pat. No. 2,741,333 cited above, shows a centrifuge for separating impurities in oil, with a peripheral annular space divided into separate dirt pockets. This separator also required the entrance of the input fluid under pressure.

U.S. Pat. No. 3,702,704 disclosed a noncontacting seal for a centrifuge. However, the seal was concerned with preventing slurry leakage at the entrance to a centrifuge rather than downstream, where a different type problem arises with the centrifuge-pumping apparatus of the present invention described below. Moreover, the structure of the disclosed noncontacting seal is quite different from that of a noncontacting seal included in the present separator.

In the food industry there has been an acute need for a device which will efficiently remove hard foreign matter, particularly bone, glass, plastic, and metal fragments, from a food product without changing the physical character (e.g., the chunk size and shape) of the product. This has been true particularly in recent years, wherein automated processes have been increasing, adding to the risk of contamination by these substances. Bolts, metal shavings, etc. from equipment often find their way into food products. Buckshot, fence nails, barb wire, etc. are often present in beef. Dectectors for metals, in particular, have been plentiful although very costly. The detectors, however, do not actually remove the impurities, and large quantities of contaminated product must simply be dumped for lack of a way to separate the product from the contaminants. There have been magnetic separators useable with very fluid products, but these have been unable to remove anything but ferrous metal impurities.

Hughes U.S. Pat. No. 4,015,784 is directed to a food batter emulsifying apparatus involving a centrifuge disposed upstream of a series of emulsifying orifices. The centrifuge has been found effective to remove heavy impurities such as metal fragments from the input slurry. However, the disclosed apparatus has not been found useful for the purposes for which the present invention is intended, for several reasons. For one thing, the metal impurities caught are not truly trapped, but are allowed to fall into emulsifying orifices directly below the peripheral wall of the centrifuge chamber whenever the rotation of the machine is stopped, posing a risk of recontamination. Even if the foreign matter were contained in the centrifuge, it would be difficult to retrieve, since there is no easy way of uncovering the centrifuge chamber for cleaning. A very important difference between the Hughes machine and the present invention is that food material cannot go through Hughes' centrifuge without being changed in character, i.e. broken up and crushed. An initial part of the emulsifying is actually performed in the centrifuge chamber, where an impeller strikes the product and there are obstructions against which product chunks are beaten and caught. The fact is that Hughes' device is effective for its intended purpose as an emulsifier, but cannot serve the purposes of the present invention due to very important structural differences.

No centrifugal separating device of the prior art has been capable of performing the dual functions of efficient foreign matter separation, without separation of lights and heavies of the product itself, and handling of the product in such a way as to avoid tearing, crushing, emulsifying and other damage to the prouduct's components.

SUMMARY OF THE INVENTION

The present invention is a separator designed specifically to remove dense impurities, such as metal, glass, plastic or bone fragments, from a slurry or partially fluidized mass, without changing the physical nature of the product passing through the apparatus and without the need for pressurization of the incoming mass, in the case of most food products. The impurities are usually present only in trace amounts, although somewhat larger amounts can be handled. The small volume of separated impurities is retained inside the apparatus, and is prevented from mixing with the purified slurry when rotation of the centrifuging chamber is stopped. Restarting of the device will not pass these impurities through the apparatus to exit with the purified material, but will leave the impurities in the centrifuging chamber. They are easily removed when the chamber and surrounding apparatus are cleaned, by removal of a quick-release cover. The retention of the impurities within the chamber permits simplicity of the apparatus, eliminating the need for two separate discharges and the usually attendant requirement of input pressurization.

A novel combination of features effects the movement of a hopper-fed input slurry, which may be a relatively sticky, tenacious mass, through the separator apparatus without the need for pressurization. In fact, pressurization is desirably avoided in the case of many products (particularly foods) wherein chunks of the input slurry are to be left intact. The centrifuge includes an impeller which is preferably of a specific size and spatial relationship to an adjacent inlet opening from the hopper. This, in combination with a set of pumping vanes mounted on the centrifuge chamber body but outside the chamber, establish a continuous flow of initially unpresurized product from the inlet opening to a discharge outlet. In the case of some food products the impeller configuration may also play a part in this flow induction. By enabling the use of simple gravity feeding from a hopper, these features greatly enhance the commercial utilizy of the present separator apparatus.

The dense foreign particles from the input slurry are collected on a peripheral wall of the centrifuge chamber. In an embodiment of the invention wherein the centrifuge's rotational axis is vertical, a trough or recess at the bottom of the cylindrical peripheral wall traps dense particles which have been collected, once rotation is stopped and the particles have fallen to the bottom of the wall. The flow passage out of the chamber is spaced inwardly from the wall, with the particle catching trough between this passage and the wall, so that the trapped particles cannot fall into the outflowing product and recontaminate it. In an embodiment with the centrifuge axis horizontal, the collected particles may fall to different areas of the peripheral wall but remain trapped in the chamber.

In the avoidance of physical damage to soft products fed through the present separator, one of the most important features is that the centrifuge chamber is structured to have no internal obstructions against which the product could be mutilated or caught. In fact, the impeller itself extends axially only part way through the chamber, being spaced from the inlet opening, so that there is actually very little contact between the impeller and the product. The flow into the chamber from the hopper is cycloidal, so that the throwing outward of the product in the chamber occurs principally by induced movement through contact of the slurry with itself.

The flow characteristics of the present separator also help avoid damage and unwanted separation of the product itself by establishing a high throughput rate. The impeller and inlet arrangement, in cooperation with the pumping vanes downstream of the chamber, move even relatively viscous product through the chamber at a rate fast enough that the product remains in the chamber a very short period of time (less than one-tenth of a second for some food products,) thereby reducing the opportunity for the product to be mutilated and avoiding separation of emulsions (e.g., frankfurter emulsions, into water, fat and meat), but still providing for adequate foreign material separation.

Because of the optimum flow established by the separator apparatus, it also serves effectively as a transfer pump, moving the product on to the next processing station.

The centrifuge and a surrounding housing are arranged so that a cover over the centrifuge chamber body may be quickly and easily removed for cleaning. A noncontacting seal, involving two annular close-fitting and overlapping flanges or ledges on the chamber body and on the removable housing portion, prevents leakage of purified slurry from its intended path between the centrifuge and the outlet of the apparatus.

Accordingly, it is among the objects of the invention to provide a separator capable of removing denser trace impurities particularly from a slurry or partially fluidized mass such as is typical with food products without changing the physical character of the input product and without the need for pressurized input feed of the product. Complex, cumbersome, and difficult-to-clean apparatus is avoided. These and other objects, advantages and features of the invention will be apparent from the following description of the preferred embodiments of the invention, taken in conjunction with the accompanying drawings.

DESCRIPTION OF THE PREFERRED EMBODIMENTS

Figure 1:
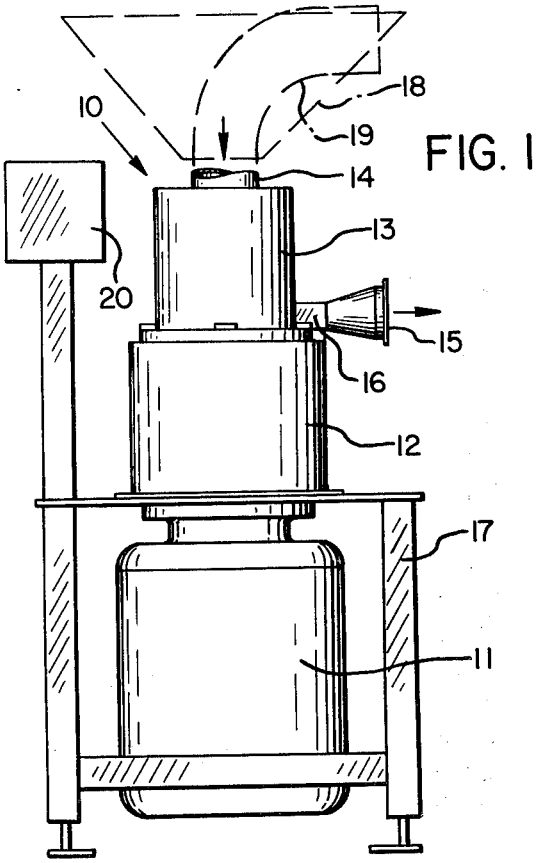
FIG. 1 is an elevation view of a separator apparatus according to the invention.

In the drawings, FIG. 1 shows a centrifugal separator 10 according to the invention, the apparatus including a drive motor 11, a drive coupling unit 12, a centrifuge and pumping unit 13 driven by the motor 11, and a product inlet 14 and product outlet 16 connected to the unit 13. The outlet 16 extends tanjentially from the unit 13, being rectangular and terminating in a circular fitting 15. All components are supported on a frame 17. The inlet 14 to the centrifuge unit may be fed by a hopper 18 or by a closed feed conduit 19, both of which are shown in dashed lines in FIG. 1. An electrical panel 20 may be included, also supported on the frame 17.

Figure 2:
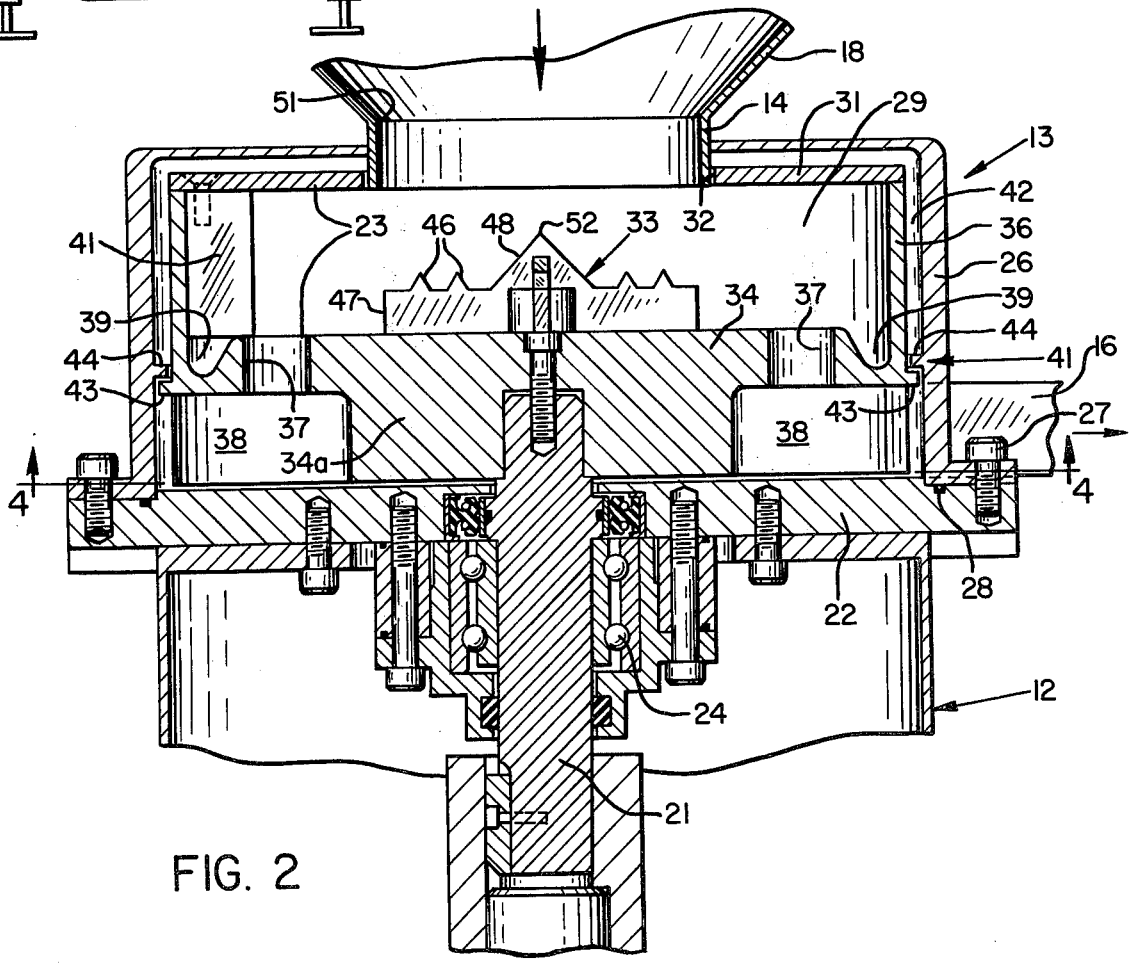
FIG. 2 is an enlarged sectional elevation view showing the principal features of the apparatus.

FIG. 2 shows the centrifuge and pumping unit 13, embodying the principal features of the invention, in section. A drive shaft 21 comes up from the motor 11 and coupling unit 12, passes through a housing base plate 22, and connects drivingly with a rotatable centrifuge chamber body 23. A bearing 24 supports the upper end of the shaft and the chamber body 23 for rotation. Surrounding the chamber body 23, in conjunction with the following base plate 22, is a housing cover portion 26, to which the product inlet 14 and the hopper 18 (or feed conduit 19, if used) are affixed. The cover portion 26 is itself removably attached to the housing base 22 by means of easily releasable fasteners 27, to facilitate cleaning. An annular static seal 28 prevents leakage of the purified product from between these housing components.

The chamber body 23 includes a centrifuge chamber 29 which is preferably cylindrical as shown, but may be frustoconical in shape, if desired, to aid in the flow of product and in the collection and segregation of dense particles from the product slurry. The chamber has an inlet end plate 31 with a central opening 32 which is only slightly larger in diameter than the stationary inlet collar 14. A form of seal is thus formed by this close fit between stationary and rotatable components, but this is not a critical area for slurry leakage, since little pressure is developed here.

Within the chamber 29 is an impeller 33, affixed to a discharge end wall 34 of the chamber body and rotatable therewith. The chamber body 23 and impeller 33 are coaxial with the inlet 14, and as indicated in FIG. 2, the impeller may be of about the same effective diameter as the inlet 14. The impeller serves to initiate or induce the outward throwing of the incoming product mass toward the peripheral wall 36 of the chamber body. A cycloidal flow is developed as the product mass from the hopper swirls downwardly toward the impeller. During centrifuging, denser particles such as metal chips or bone fragments, particular problems in the case of food products, collect on the peripheral wall 36. The remaining purified product is forced by the centrifuge-induced pressure toward a series of discharge openings 37 in the discharge end wall 34, leading to an annular discharge chamber defined by the chamber body 23 and the housing components 22 and 26 just below the discharge openings 37. However, the flow of the product is aided by a series of pumping vanes 38 within the discharge chamber which centrifugally pump the mass or slurry out the outlet 16, which is preferably tangentially positioned on the housing cover 26. A portion of the outlet is seen in FIG. 2, since this sectional view is looking in the same direction as FIG. 1. Together the vanes 38, which are affixed to the chamber body 23, and the rotation of the actual chamber 29 and impeller 33, cooperate to move only partially fluidized and often fairly sticky input masses through the apparatus. In the case of masses particularly resistant to flow, however, dimensional relationships at the inlet and the impeller are also important for effective flow induction, as explained further below.

As is apparent from FIG. 2, the centrifuge chamber 29 is free of initial obstructions against which outwardly moving product could be mutilated or caught. Also, the impeller 33 is spaced a substantial distance from the inlet 14, allowing product to enter the chamber 29 without being struck directly by the impeller. In fact, almost all of the incoming product avoids contact with the impeller and is induced to be thrown rapidly outwardly by the cycloidal inflow associated with the impeller and the rotation of the chamber. Both these features cooperate to virtually eliminate high-velocity contact of the product with hard, sharp and otherwise destructive surfaces, and the features are very important in avoiding mutilation of food products.

FIG. 2 also shows troughs or recesses 39 in the discharge end wall 34, directly at the bottom of the peripheral wall 36 of the chamber 29. These troughs are nearly continuous around the periphery of the chamber, but may be interrupted by a series of posts 41, of which one is visible at the left side of FIG. 2. There may be two, three, four or more of such posts, if they are included, but for clarity only one is shown in FIG. 2. Positioned adjacent to the wall 36 and extending only a short distance inwardly in the chamber, they add structural integrity and balanced mass to the rotatable chamber body 23.

The troughs 39 catch the dense foreign particles which have collected on the peripheral wall, once rotation is stopped or decelerating and these particles have fallen. There the dense particles remain, through successive uses of the separator 10, without entering the stream of slurry flowing out the discharge opening 37. Of course, the separator is operable on some products which are not extremely fluid, but rather sticky and resistant to flow. In the case of such input masses, such as chunked or ground meats, for example, the dense foreign particles or fragments collected on the peripheral wall 36 tend to remain there when rotation is stopped. Nonetheless, this objectionable foreign matter (e.g. bone or metal particles, in the case of meats) stays on the wall 36 through successive uses of the separator, without entering the moving stream of purified product. When the chamber body 23 and housing components 22 and 26 are cleaned this collected foreign material is removed. Often meat chunks are found on the wall, containing metal or bone fragments within them. When dense foreign particles are inside a chunk, the centrifuge tends to carry the whole chunk to the wall.

The positional relationship among the peripheral wall 36, the troughs 39, and the discharge openings 37 is very important. The inward spacing of the openings 37 from the wall 36 prevents the falling of separated objects back into the product flow when rotation is stopped. Instead, the troughs 39, between the openings 37 and the wall 36, trap such falling separated objects, in this vertical-axis embodiment.

FIG. 2 shows a noncontacting annular seal 41 between the rotatable chamber body 23 and the stationary housing cover 26, which is a critical sealing area because of the pressure at that location developed by the pumping of product toward the outlet 16. The purified product must be prevented from entering the annular space 42 between the body 23 and the cover 26 to any appreciable extent. The seal 41 may comprise an extending annular flange 43 near the outside bottom of the peripheral wall 36 of the body 23, coming into close proximity with the housing cover 26, in conjunction with a closely positioned similar annular projection 44 on the inside of the housing cover. These noncontacting seal members create a narrow and tortuous path through which the somewhat pressurized exit slurry is substantially prevented from traveling. Of course, the close-fitting seal members 43 and 44 need not be structured precisely as shown; it would be sufficient merely that a ledge of the housing cover, where the cover's internal surface changes from a smaller diameter to a larger diameter, is positioned closely adjacent to a complimentarily shaped ledge of the centrifuge body. The housing cover ledge should be above the centrifuge body ledge in this embodiment of a removable cover, as shown, so that the cover 26 can be pulled axially off the centrifuge body 23.

Figure 3:
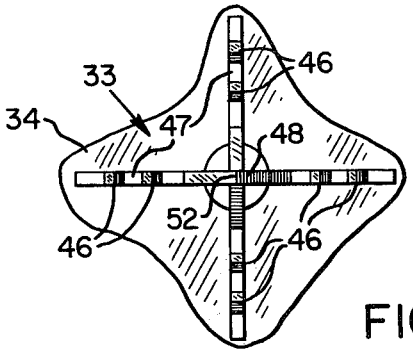
FIG. 3 is a plan view of an impeller forming a part of the separator apparatus.
Figure 4:
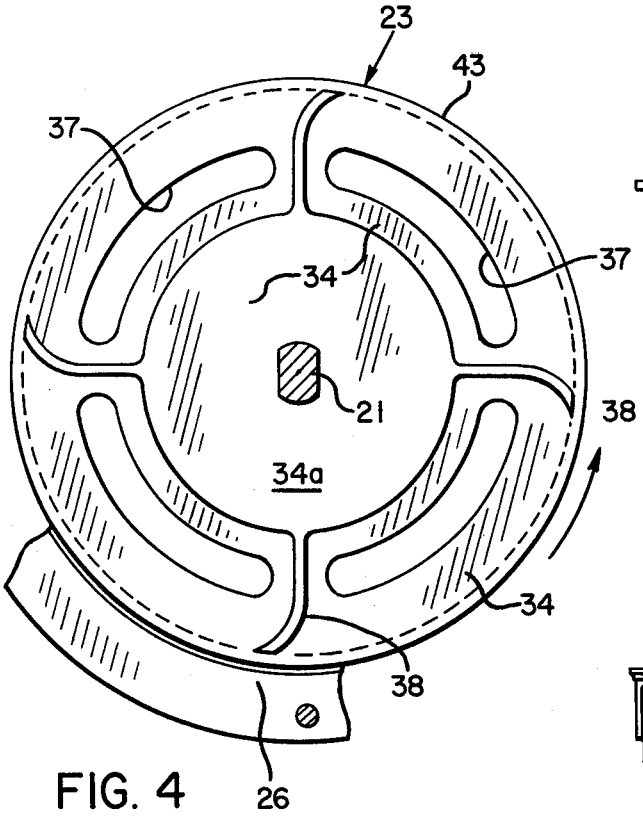
FIG. 4 is a bottom view of a centrifuge chamber body of the apparatus, taken along the line 4—4 of FIG. 2

FIGS. 3 and 4 show further details of the centrifuge and pumping unit 13. FIG. 3 shows the impeller 33 alone in plan view. Teeth 46 (see also FIG. 2) extend upwardly from radial legs or blades 47, and they may have sharp linear points as indicated. A large central tooth 48 may also be included, providing a directional division point for the incoming slurry, and helping establish the axis of the cycloidal flow. The four bladed impeller 33 shown, with teeth positioned approximately as shown, has been found effective for aiding in centrifuging action and also for initially separating or parting the incoming mass, in the case of a viscous or coherent input, without mutilating the component items. This impeller is also effective in establishing the cycloidal flow of the incoming product from the hopper 18 to the vicinity of the impeller and the flow from the impeller ultimately to the discharge openings 37.

As mentioned above, some of the dimensions involved with the inlet opening 14 and the impeller 33 may be important for maintaining the flow of an adherent type mass with considerable resistance to flow. It has been found that for a rotational speed of 1800 r.p.m. and a chamber inside diameter of elevan inches, an effective diameter (overall length of an aligned pair of blades 47) of the impeller 33 is about five inches. The inlet opening 14 diameter may be approximately the diameter of the impeller for such adherent masses (meats, for example), and generally should not exceed that diameter, since the flow path of the incoming mass should not to any great extent fall outside the impeller's cycloidal influence. In the case of more fluid slurries, it may be desirable to restrict flow by providing an inlet of smaller diameter. The impeller may then be made somewhat smaller, particularly for use with less viscous, more fluid food products.

The distance from the inlet 14 to the impeller may also be important in the case of adherent non-fluid masses, which may be difficult to pull into the chamber if the distance is too great. It has been found that for a chamber diameter of eleven inches and a rotational speed of 1800 r.p.m., the distance from the upstream end 51 of the inlet 14, where the hopper 18 narrows into the inlet, to the tip 52 of the large impeller tooth 48, should be in the neighborhood of about 1¾ inches for optimum cycloidal inflow and throughput of product.

Another factor which may be important for throughput of non-fluid masses is the axial distance from the upstream end 51 of the inlet to the discharge openings 37. IN general, and depending upon the nature of the product, the flow problem is greater when this distance is greater. A distance of about 3¼ inches has been found effective.

The inside diameter of the chamber 23 should not exceed about eleven inches, for a rotational speed of 1800 r.p.m. Greater diameters tend to cause too much force to be developed as the product approaches the peripheral wall 36, and this can damage or change the chunk size of food products, as well as tend to cause separation of high and low density components of the product itself.

If the separator 10 includes a feed conduit 19 (FIG. 1) rather than a hopper, the axial dimensions discussed above are measured from where the feed pipe bends away from the inlet or becomes narrower.

In some circumstances it may be advantageous to operate the centrifuge at a lower speed. For example, for more delicate food products a lower speed is gentler on the food components. Of course, for impurities which are only slightly denser than the main product, speed is improtant and must be high enough for adequate separation. Toward these ends, the motor 11 may be a variable speed motor.

FIG. 4 shows the centrifuge chamber body 23 in bottom plan view, as viewed along the line 4—4 of FIG. 2. As indicated, the upper end of the driving shaft 21 may be of a noncylindrical shape, so that the chamber body 23 and shaft are keyed for rotation together. The vanes 38, which are preferably integral with the chamber body, may curve backward as shown, in order to throw or push the material out the discharge port. The vanes 38 of course occur at interruptions in the arcuate discharge openings 37. This is not only convenient, but also adds to the structural strength of the chamber body 23 by rigidly connecting the outer portion of the discharge end wall, beyond the discharge openings 37, with the inner portions which include a thickened central block 34*a* to which the vanes are integrally joined.

All of the centrifuge and pumping unit 13 components which may come into contact with the input product are preferably of stainless steel. This includes the hopper 18 (or feed conduit 19, if utilized), the inlet 14, the housing components 26 and 22 and the chamber body 23, including the impeller 33.

Figure 6:
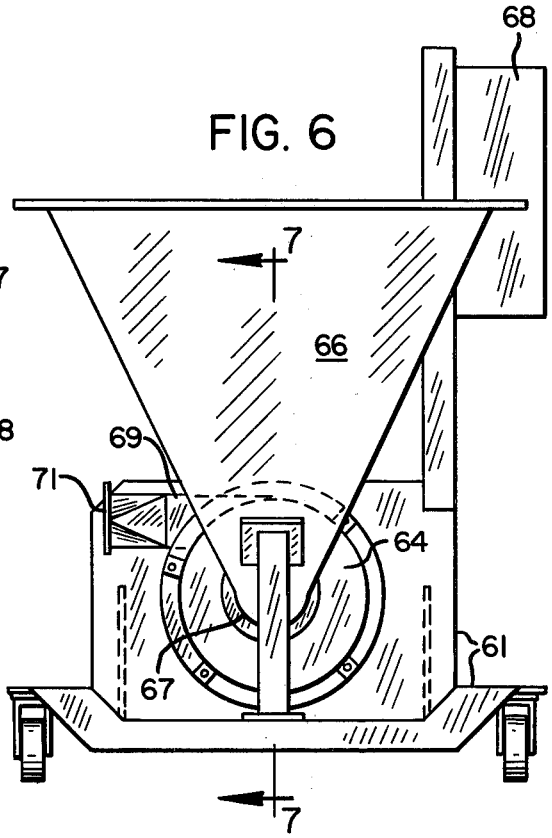
FIG. 6 is an end elevation view of the embodiment shown in FIG. 5.
Figure 5:
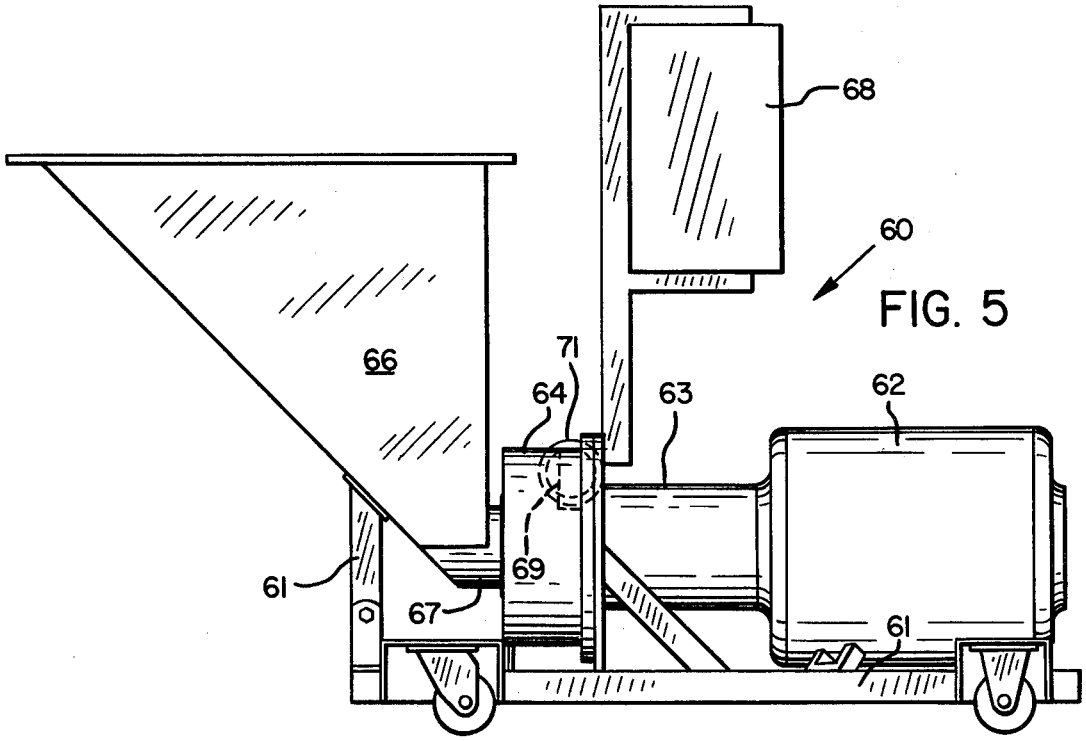
FIG. 5 is a side elevation view of another embodiment of the invention wherein the centrifuge axis is horizontal.
Figure 7:
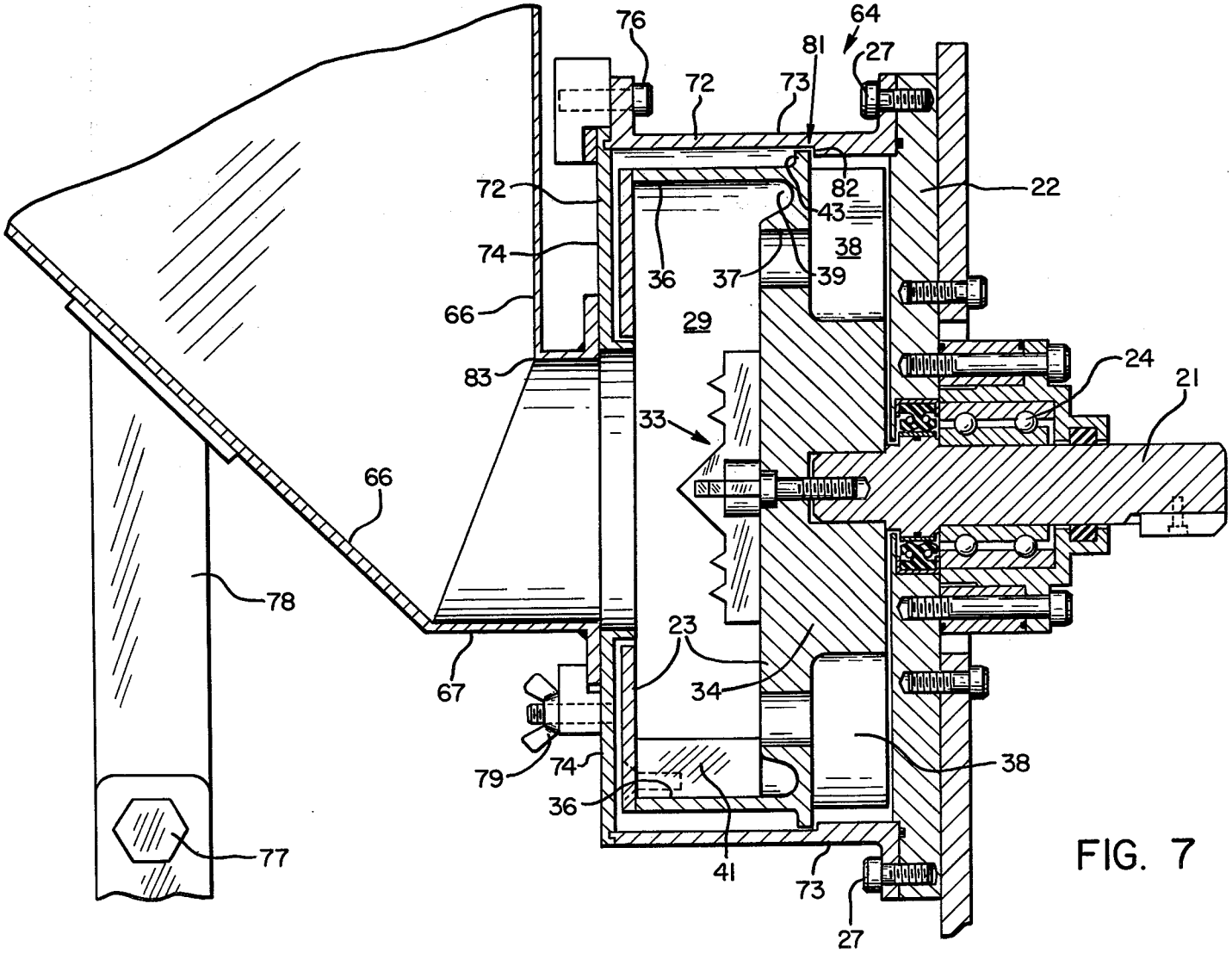
FIG. 7 is an enlarged sectional view of a portion of the same embodiment, taken generally along the line 7—7 of FIG. 6.

A second embodiment of the invention shown in FIGS. 5, 6 and 7 is identical in many respects to the first embodiment described above, the main difference being that this embodiment has a horizontal axis of rotation rather than vertical. FIGS. 5 and 6 shows a caster-mounted separator assembly 60, including a frame 61 supporting a motor 62, a drive connection unit 63, a centrifuge and pumping unit 64 and a hopper 66, leading into the unit 64 via a cylindrical inlet 67. An electrical panel 68 is also shown supported on the frame 61. FIG. 6, a view from the hopper end, also shows a product outlet comprising a retangular outlet conduit 69 extending tangentially from the centrifuge unit 64 and terminating in a circular outlet fitting 71.

FIG. 7 shows the centrifuge and pumping unit 64 in sectional view, as viewed along the line 7—7 of FIG. 6. As such, the position of view is rotated from that of FIG. 2, and the discharge outlet 69 is not visible in FIG. 7. Obviously this unit is nearly identical structurally with the unit 13 shown in FIG. 2, except that the axis of rotation is horizontal. The horizontal unit is more versatile in many instances in the food industry where the hopper must cooperate with other equipment and thus must be at a lower elevation than that of the hopper 18 of the vertical embodiment.

Most of the unit 64 has already been described with reference to FIG. 2, and like reference numbers are applied; only the differences between the two embodiments will be discussed here.

The horizontal unit 64 has a housing cover portion 72 which opens for cleaning in a different manner from the vertical embodiment. A cylindrical portion 73 of the housing cover 72 does indeed detach from the housing base portion 22, in case this is needed, by means of removable fasteners 27, but the apparatus is opened for cleaning by removal of an end plate 74 of the housing cover 72. The plate 74 is connected to the cylindrical portion 73 of the housing cover by removable fasteners 76 located at various positions around the cover 72.

The hopper 66 and inlet 67 assembly is also easily removable from the end plate 74. A pivot point 77 on a hopper supporting strut 78 of the frame 61 permits the outward pivoting of the hopper and inlet when one or several quick-release fasteners 79 are released. This enables the hopper and inlet, and the centrifuge chamber 29, if desired, to be cleaned. Separated dense material collected on the peripheral can be removed.

Once the hopper 66 and inlet 67 have been pivoted aside, the end plate 74 may be removed for cleaning of the entire assembly. By unscrewing of the impeller 33 from the shaft 21, the centrifuge chamber body 23 may be pulled out of the housing, facilitating cleaning of all components and areas where the slurry may make contact.

As indicated in FIG. 7, a noncontacting seal 81 between the housing cover 72 and the centrifuge chamber body 23 is arranged differently from the seal of the vertical-axis embodiment. The annular projection 43 of the chamber body is the same (and if fact, the entire chamber body 23 is preferably the same and interchangeable), but a closely fitting ledge 82 of the housing's cylindrical member 73 is positioned on the downstream side of the projection 43. The seal 81 functions similarly to the earlier described seal, but this reversed arrangement provides for removal of the chamber body 23, rather than of the housing cover 72.

The importance and often criticality of dimensions for proper flow are generally the same in this horizontal embodiment as in the vertical embodiment. In this case the axial inlet-to-impeller distance is measured from a point 83 at the upper end of the inlet where its axial length is shortest and the hopper bends sharply into the inlet.

As noted above, in this horizontal embodiment the dense foreign particles are collected on the peripheral wall 36 and remain there even after rotation is stopped. The peripheral trough 39 of the chamber body is included here only for the sake of interchangeability of the chamber body with that of the vertical embodiment; it performs no function in this horizontal-axis separator. However, the radial spacing between the peripheral wall 36 and the discharge openings 37 is important here, as in the first embodiment, for preventing recontamination of the product by trapped particles.

It should be understood that although both embodiments described include preferred arrangements of components and preferred flow paths, etc., there are alternative ways some of the components can be arranged. For example, the discharge openings 37 need not be in the chamber end wall opposite the inlet opening. They may be in the same end wall, positioned between the inlet opening and the peripheral wall, still spaced radially inwardly from the peripheral wall (arrangement not illustrated). In this case the pumping vanes 38 would of course be just outside the discharge openings, still preferably integral with the chamber body. The product outlet opening would be adjacent to the discharge chamber, where the vanes are, with the noncontacting seal positioned near the outlet. The housing cover-hopper assembly would still be easily removable.

The separating apparatus of the invention was tested on several different slurried food products, and the test conditions and results are set forth in the examples below.

EXAMPLE I

HASH

The input consisted of ground beef which had been put through a ⅛ inch grinder, ½ inch cubed potatoes, spices, and water, cooked at about 120° F. The potato cubes were soft. Five hundred pounds of this mixture, plus some lead pellets, metal wire, nuts, and bolts which we added, were put through the separator. All of the added metal was retained in the centrifugal chamber.

The vertical model at 1800 rpm was used in this test with an eight inch diameter centrifuge chamber having an inside axial dimension of about seven inches. The impeller was also taller than the preferred size given above, but was still recessed about two inches from the point 51 at the upstream end of the inlet. The impeller diameter was about five inches, as was that of the inlet opening. Five hundred pounds went through the unit is less than twenty seconds. The hash was moist and relatively free flowing.

The nature of the discharged material was identical to the input except for the metal removal. The texture of the hash was the same with no separation of meat, potatoes, spices or water. The potato cubes still had sharp edges.

EXAMPLE II

COARSE GROUND POLISH SAUSAGE OR SALAMI

The input product consisted of beef and pork ground through a ¼ inch grinder, spices, and water, with added metal wire, nuts and bolts. The flow characteristics of the product were like a heavy wet cement, very sticky and tacky. The temperature of the product was 45° F. going out.

The vertical unit processed 500 pounds in about a half minute; the horizontal unit processed 500 pounds in a full minute. The rpm was 1800 and the rotating chamber was 11 inches diameter. Other dimensions were the preferred dimensions given above.

The fat and water did not separate from the mixture, but rather, the product from the discharge was exactly the same texture and appearance, as the input except that the added metal wire, nuts, and bolts were retained in the centrifuge chamber along with some bone fragments and other metal pieces which had not been added.

EXAMPLE III

FRANKFURTER EMULSION

This mixture consisted of typical raw materials to make frankfurters, beef and pork, spices, salt, and water, with nuts and bolts added. The input mixture had already been finely ground and emulsified. These emulsions or batters are delicate in that they will separate out fat if given too much agitation. The emulsion was quite fine in that no particles could be felt.

Five hundred pounds of this mixture was processed on the horizontal model in about a full minute. The input temperature was 60° F., and output at about 64° F. The dimensions of the separator unit were the same as the preferred dimensions given above.

The discharged material had the same consistency, appearance and texture as the input, but without the added nuts and bolts. In addition to the metal deliberately added to the input mixture, stainless steel slivers were found. There was no bone found since any bone in the input was finely ground.

The above described preferred embodiments provide centrifugal separating apparatus which is highly efficient in removing from an input mass fragments of denser material, particularly in foods, without physically damaging the product to be purified. A combination of features assures throughput of even a relatively adherent, non-fluid input mass, with simplicity and economy of structure. Various other embodiments and changes to these preferred embodiments will be apparent to those skilled in the art and may be made without departing from the spirit and scope of the invention as defined by the following claims.

We claim:

1. A centrifugal separator for separating from a product mass particles which are denser than the mass, without discharging the separated particles and without appreciably changing the physical character of the product mass, comprising:

an enclosed rotatable chamber body defining an internal centrifuge chamber, having an annular peripheral wall and having two end walls at opposite axial ends of the chamber, with an axial inlet opening in one end wall, said centrifuge chamber being open and unobstructed between the inlet opening and the peripheral wall;

a housing surrounding the chamber body, including means mounting the chamber body for rotation about its axis;

motor means for driving the chamber body rotatably;

an impeller mounted axially within the chamber for rotation with the chamber, in the path of the inlet opening, extending axially part way through the chamber and recessed from the inlet opening;

one of said end walls including at least one discharge opening for purified product, said opening being spaced radially inwardly from the periphery of the chamber;

a product discharge chamber within the housing, adjacent to the centrifuge chamber and communicating therewith through the discharge opening;

an outlet in the housing adjacent to the discharge chamber;

at least one product pumping vane mounted on the chamber body and positioned in said discharge chamber, for pumping, in conjunction with the impeller, the purified product into the centrifuge chamber, from the centrifuge chamber into the discharge chamber, and from the discharge chamber through the outlet; and sealing means between the rotatable chamber body and the housing, for preventing flow of product from the discharge chamber between the chamber body and the housing;

whereby a product mass is induced to flow through the inlet opening and into the centrifuge chamber, toward the impeller, in a cycloidal path, experiencing little contact with the impeller, and is thrown toward the periphery of the centrifuge chamber unobstructed, with denser foreign particles from the product mass collected on the peripheral wall while the purified product mass is discharged, said product mass remaining in the centrifuge chamber a relatively short period of time, resulting in a discharged product having unchanged physical characteristics from the input product.

2. The separator of claim 1 which further includes a hopper mounted on the housing adjacent to the inlet opening.

3. The separator of claim 1 wherein said impeller has a plurality of radially extending blades, each having teeth extending toward the inlet opening, and a central tooth positioned on the axis of the impeller.

4. The separator of claim 3 wherein the centrifuge has an inside diameter of about eleven inches, the impeller has an effective diameter of about five inches, and the centrifuge body rotates at about 1800 rpm.

5. The separator of claim 3 wherein the inlet opening has a diameter of about five inches.

6. The separator of claim 3 wherein the inlet opening has an axial length of constant diameter, and the distance between the upstream end of said axial length and the tip of said central booth is about $1\frac{3}{4}$ inches.

7. The separator of claim 1 wherein said discharge opening is in an end wall opposite the end wall having the axial inlet opening.

8. The separator of claim 1 wherein the axis of the centrifuge chamber is vertical with the inlet opening upward and the chamber includes, in the lower end wall, a trough at the bottom of said annular peripheral wall, for catching, in the case of relatively fluid product masses, foreign particles which have been collected on the peripheral wall and which fall by gravity when the rotation of the centrifuge chamber is stopped.

9. The separator of claim 8 wherein said discharge opening is in the lower end wall.

10. The separator of claim 1 wherein said sealing means is a non-contacting seal comprising an annular flange extending outwardly from the chamber body near the discharge chamber, and a closely positioned annular ledge of the housing, forming an annular overlap area.

11. The separator of claim 10 wherein said housing includes a base portion perpendicular to the axis of the centrifuge chamber and on the opposite side of the chamber body from the inlet opening, covering said opposite side, and a cover portion removably attached to the base portion and surrounding the remainder of the chamber body, with an opening in the housing at the location of the centrifuge chamber inlet opening, said annular ledge being on the cover portion of the housing on the side of the chamber body annular flange opposite that of the base portion, whereby the cover portion can be disconnected from the base portion and removed axially from the chamber body for cleaning of the separator.

12. A method for separating dense foreign objects from a food mass, comprising:

inducing a cycloidal flow of the mass into a rotating centrifuge chamber;

throwing the mass outwardly, unobstructed, toward a peripheral wall of the centrifuge chamber and leaving the mass in substantially unchanged physical condition;

collecting and retaining the dense foreign objects on the peripheral wall of the centrifuge chamber; and passing the unchanged, purified food mass through a discharge opening spaced radially inwardly from the peripheral wall.

13. The method of claim 12 which further includes, following said passing step, the step of pumping the purified food mass out an outlet by means of vanes rotating with the centrifuge chamber.

14. The method of claim 12 which further includes stopping the rotation of the centrifuge chamber and collecting the dropping foreign objects in a trough below the peripheral wall.

15. A method for separating dense, hard foreign objects from a food mass, comprising:

feeding the contaminated food mass into a rotating centrifuge chamber;

separating from the mass and collecting the dense foreign particles on a peripheral wall of the centrifuge chamber, without mutilating components of the mass; and discharging the purified food mass from the chamber through a discharge opening spaced radially inwardly from the peripheral wall, while retaining the foreign particles on the peripheral wall.

* * * * *

UNITED STATES PATENT AND TRADEMARK OFFICE

CERTIFICATE OF CORRECTION

PATENT NO. : 4,140,270
DATED : February 20, 1979
INVENTOR(S) : Brian M. Dowd and John A. Kneeland It is certified that error appears in the above-identified patent and that said Letters Patent are hereby corrected as shown below:

Column 2, line 61, "utilizy" should read --utility--.
Column 4, line 32, "following" should read --housing--.
Column 5, line 17, "initial" should read --internal--.
Column 7, line 10, "IN" should read --In--.
Column 9, line 28, "1/2" should read --1/4--.
Column 11, line 41, "booth" should read --tooth--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*